United States Patent [19]

Martin

[11] Patent Number: 4,610,846

[45] Date of Patent: Sep. 9, 1986

[54] COMPARTMENTALIZED CENTRIFUGATION CHAMBER

[76] Inventor: Hans Martin, Schmidten 2, D-7201 Rietheim-Weilheim 1, Fed. Rep. of Germany

[21] Appl. No.: 642,121

[22] Filed: Aug. 17, 1984

[30] Foreign Application Priority Data

Aug. 18, 1983 [DE] Fed. Rep. of Germany ..... 3329873

[51] Int. Cl.[4] ..... B01L 11/00; B04B 5/02

[52] U.S. Cl. ..... 422/101; 422/102; 494/16; 494/20

[58] Field of Search ..... 422/72, 102, 101; 494/20, 16

[56] References Cited

U.S. PATENT DOCUMENTS

| | | | |
|---|---|---|---|
| 817,465 | 4/1906 | Bragg | 494/57 |
| 3,202,348 | 7/1965 | Strohmaier | 494/20 |
| 3,456,876 | 7/1969 | McEwen | 494/16 |
| 4,119,407 | 10/1978 | Goldstein et al. | 422/101 |
| 4,129,419 | 12/1978 | Hermann | 494/20 |
| 4,141,489 | 2/1979 | Wright | 494/20 |
| 4,214,993 | 7/1980 | Forsythe et al. | 422/101 |
| 4,435,168 | 3/1984 | Kennedy | 494/20 |
| 4,439,177 | 3/1984 | Conway | 494/20 |

FOREIGN PATENT DOCUMENTS 1194896 6/1970 United Kingdom .

*Primary Examiner*—Wilbur Bascomb

[57] ABSTRACT

The stability of buoyant density gradients in centrifuge tubes decreases rapidly when the volume of the tubes is increased beyond 50-100 ml because vortices form in large tubes on acceleration and deceleration of the centrifuge. For large-scale density gradient separation of particles, e.g. blood cells, using centrifuge tubes it is therefore necessary to distribute the material into a number of small tubes. This time consuming procedure is simplified by using a compartmentalized centrifugation chamber subdivided by radially and vertically oriented walls or lamellae into a number of hydrostatically communicating compartments. The walls stabilize the large volume density gradient without interfering with sedimentation of the particles. As the compartments communicate, it is possible to layer and fractionate the density gradient in all compartments simultaneously, which results in a considerable reduction of time and labor required to separate large volumes of material by density gradient centrifugation.

4 Claims, 8 Drawing Figures

COMPARTMENTALIZED CENTRIFUGATION CHAMBER

BACKGROUND OF THE INVENTION

This invention is a centrifugation chamber for the separation of suspended particles by buoyant density gradient centrifugation.

Separation of biological particles such as cells, organelles and macromolecules by utilizing either differences in their buoyant densities or in particle sizes is a well-established biomedical method.

Buoyant density gradient centrifugation is used to separate particles of different densities. Centrifuge tubes containing volumes of about 10 through 50 ml are commonly used for this purpose.

Since density gradients become increasingly unstable in larger tubes and swirling occurs on acceleration and deceleration of the centrifuge, tubes of larger volumes can hardly be used even for preparative purposes.

To separate large volumes of material it is necessary to distribute aliquots into a number of small gradient tubes, which is time consuming.

Different types of zonal rotors can be used for large-scale density gradient centrifugation, but these are expensive and additional equipment, such as special pumping devices, is required.

Receptacles and devices for centrifugation which are subdivided into two or more compartments are disclosed in U.S. Pat. No. 3,456,876 and DE-OS 1,648,844 (Fed. Rep. of Germany). The subdivisions are thought to reduce the path length of sedimentation for pelleting very small particles, particularly of particles with sedimentation rates of less than $10^2$ Svedberg units, such as biological macromolecules, resulting in an overall reduction of centrifugation time required to pellet these particles. ("Svedberg unit" is a commonly used metric unit in centrifugation, having the dimension of $10^{-13}$ sec.)

These devices, however, are designed to pellet, i.e. sediment, very small particles by (ultra)-centrifugation and are not suitable for density gradient centrifugation. Compared to other parameters, buoyant density, the major criterion in density gradient centrifugation, is of minor importance for pelleting.

The objective of the present invention is to provide a device for large scale density gradient centrifugation (volume: over one hundred milliliters up to several liters), which is simple, effective and which can be used in combination with large laboratory centrifuges and the appropriate standard swinging-bucket rotors, which are widely available.

The density gradient has to be mechanically stable and unwanted swirling should be effectively prevented. In particular, the density gradient has to be sufficiently stable to withstand the rotational forces which occur during acceleration and deceleration of the centrifuge and which tend to cause unacceptable vortices in large volume gradient tubes.

In general, the objectives of the invention are accomplished by subdividing one large centrifugation chamber by means of stabilizing walls or lamellae into several compartments which are geometrically arranged as described below. The characteristic features of this invention are the walls which lie in radially and vertically oriented planes during centrifugation, i.e. in planes which are defined by both the direction of the centrifugal force and the axis of rotation.

Other features and advantages of the invention will be apparent from the following description of a preferred embodiment and from the claims.

PREFERRED EMBODIMENT

I first briefly describe the drawings.

DRAWINGS

Figure 3:
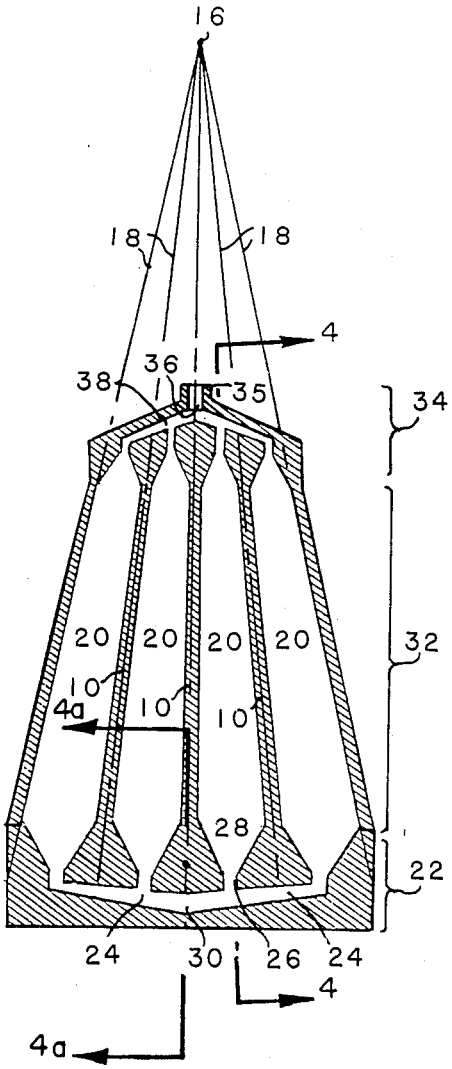
FIG. 3 is an enlarged plan view of one embodiment of the chamber of the invention shown in cross-section.
Figure 4:
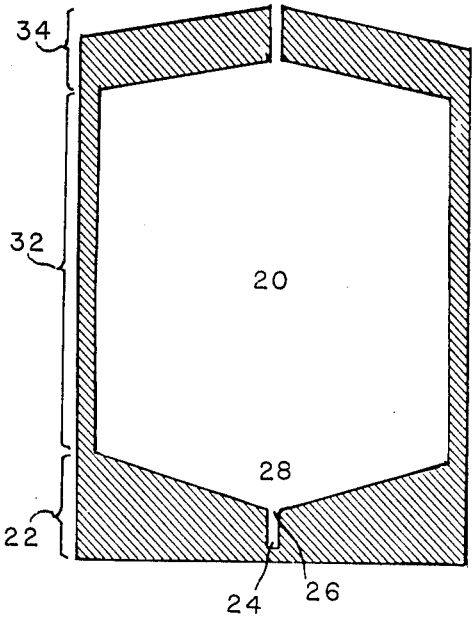
FIG. 4 is an end view in cross-section taken on line 4—4 of FIG. 3.
Figure 4A:
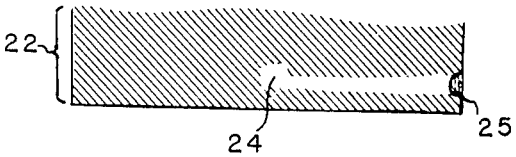
Figure 6:
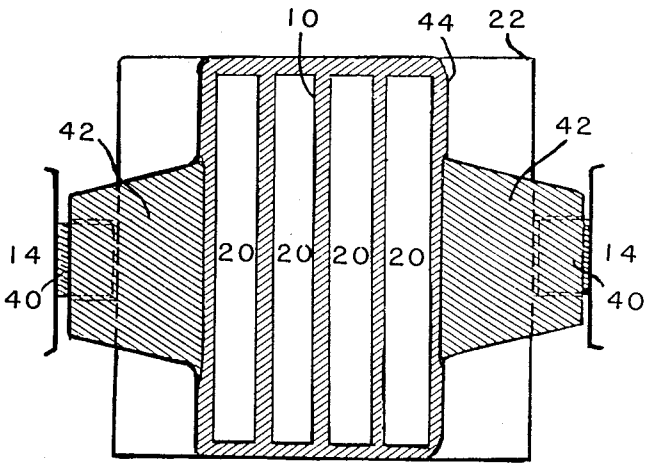
Figure 5:
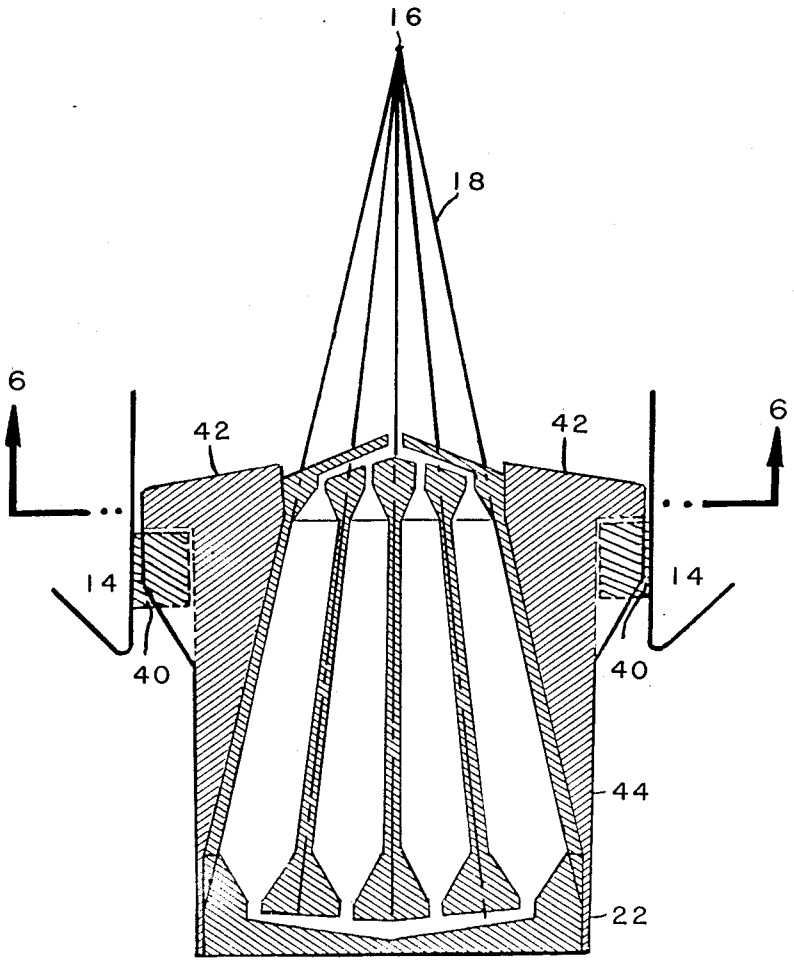

FIG. 4*a* is a sectional view taken on line *4a—4a* of FIG. 3;

FIG. 5 is a plan view of one embodiment of the chamber comprising a carrier part for suspending the chamber in a swinging-bucket rotor in cross section;

FIG. 6 is a top view section taken on line 6—6 of FIG. 5; and

Figure 7:
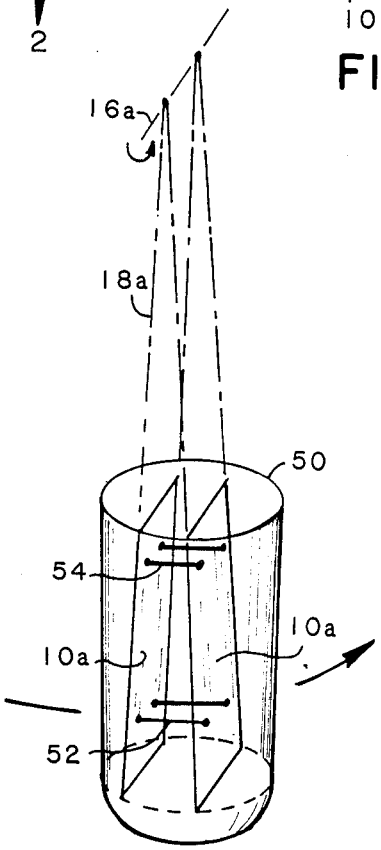

FIG. 7 is a perspective view of a large centrifuge tube compartmentalized by an insert of two mutually fixed lamellae, illustrating a different realization of a compartmentalized centrifugation chamber.

Figure 1:
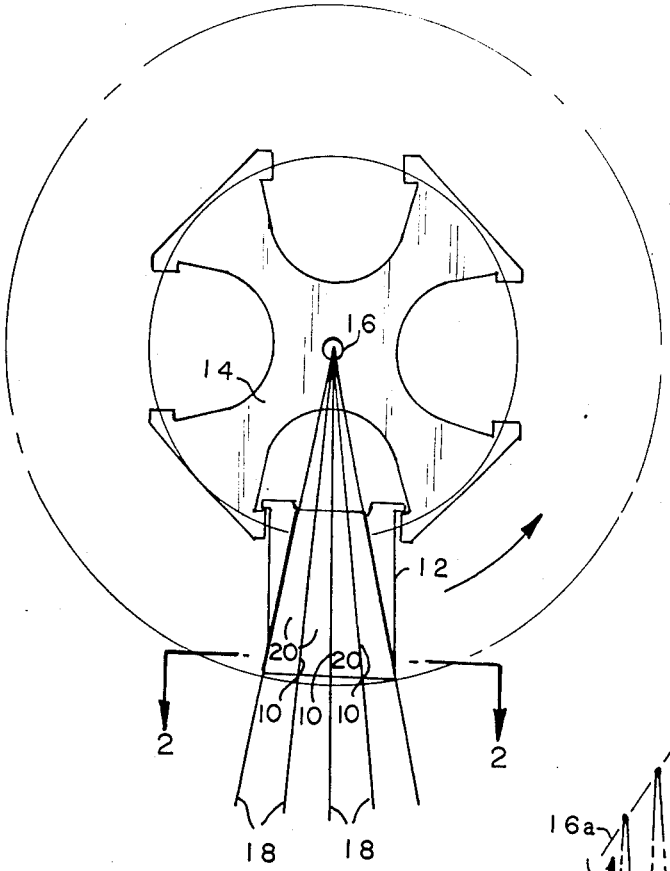
FIG. 1 is a diagrammatic plan view of a compartmentalized centrifugation chamber according to the invention set into the swinging-bucket rotor of a large laboratory centrifuge.
Figure 2:
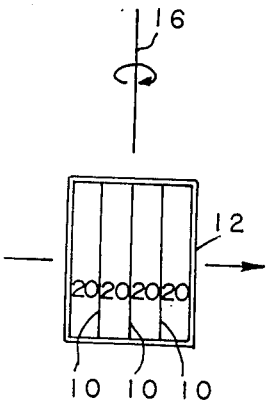
FIG. 2 is a side section view of the chamber taken at the line 2—2 of FIG. 1.

The characteristic arrangement of the partition walls 10 is schematically illustrated in FIGS. 1 and 2.

Referring to FIG. 1, there is shown a compartmentalized centrifugation chamber 12, as set into a swinging-bucket centrifuge rotor 14, which is rotating about its central axis of rotation 16. The direction of the centrifugal force is indicated by radial centrifugal force lines 18.

During centrifugation, when the compartmentalized centrifugation chamber 12 is orientated in its horizontal swing-out position, the partition walls 10 coincide with centrifugal force lines 18 and are parallel to the axis of rotation 16.

By this arrangement the walls (lamellae) 10 most effectively counteract the rotational forces occurring during acceleration and deceleration of a centrifuge in addition to the centrifugal force, and hence most effectively prevent vortex formation without disturbing radial sedimentation or flotation of the particles. In particular, by arranging the walls exactly in radial direction the compartments 20 are sector-shaped preventing "wall-effects", i.e. sedimentation of the particles against the walls.

Additional walls in radial-horizontal planes do not lead to further relevant stabilization.

Another characteristic feature of the invention comprises hydrostatic communication of the individual compartments 20 at the bottom of the gradient chamber, making it feasable to layer and fractionate the density gradient simultaneously in each of the compartments.

The main advantage of this invention is that it allows very rapid and simple layering and subsequent fractionation of a large volume density gradient. For density gradient centrifugation of volumes greater than 200 ml, considerable time and labour can be saved compared to distributing the same volume into a number of small gradient tubes.

Because the individual compartments 20 are intrinsically sector-shaped, "wall-effects" are avoided and hence resolving power of gradient separation is increased in comparison with common parallel-walled gradient tubes.

Furthermore, it is easy to design this compartmentalized gradient chamber as a completely closed system for sterile density gradient separation.

Compared to zonal rotors, which are also suitable for large-scale density gradient centrifugation, this invention has the advantage of being potentially cheaper and more convenient. As the gradient chamber is easy to transport, the place where the gradient is layered and fractionated and the place where it is centrifuged could be separate. The advantages over zonal rotors are most marked when relatively large biological particles such as whole cells and large subcellular particles are being separated because only weak or moderate centrifugal forces are required.

One embodiment of the invention is presented schematically in FIG. 3 and FIG. 4, where the chamber is shown as positioned during steady state centrifugation.

The essential elements required for simultaneous layering and fractionating are designed as integral parts of the centrifugation chamber. Furthermore, the complete chamber is a closed system with only two connectors for inlet and outlet tubing.

The centrifugation chamber consists of three functional parts:

(1) A bottom part 22 which contains a channel 24 with narrow openings 26 to the base of each compartment 20 (4 shown in FIG. 3). These inlet openings diverge as hollow oblong pyramids 28. The individual compartments 20 communicate hydrostatically by the channel 24. At it lowermost point 30 this common channel is connected by a tubing connector 25 to a pressure-fast tubing line (not shown) which runs outside the chamber to its top, where it is fixed during centrifugation. All solutions enter and may also leave the centrifugation chamber by this tube. The connection between tube and common channel has to withstand the hydrostatic pressure multiplied by the centrifugal force during the centrifugation run.

(2) A middle part 32 comprising the oblong and side by side sector shaped compartments 20.

(3) A top part 34 designed similarly to the bottom part with an outlet tubing connector 35 directly fixed to the highest point 36 of its common channel 38.

Both tubing connectors can be closed by Luer-stoppers if required.

The density gradient is layered, the lightest solution first, from the bottom of the chamber, and fractionated either by upward displacement, i.e. by introducing a dense solution via the bottom inlet tubing, or conversely, letting the gradient fractions out directly via the bottom tubing. In each case the corresponding layers of all different compartments meet in a common channel.

The compartmentalized centrifugation chamber can be designed as an accessory part to any large laboratory centrifuge with swinging-bucket rotor. The detailed measurements of the gradient chamber depend on the geometry of the centrifuge to be used.

There are different ways of suspending the chamber in the centrifuge rotor. The chamber may be adapted to fit into a large standard centrifuge bucket. Alternatively, a special centrifuge bucket may be adapted to the measurements of the chamber and of a given rotor to optimize the use of space.

FIGS. 5 and 6 illustrate an embodiment of the chamber which comprises a carrier part 42 for suspending the chamber by the pivots 40 of the swinging-bucket rotor 14.

Other parts of the chamber such as the bottom part 22 and outer walls 44 may be machined out of the same block of material as the carrier part 42, or they may be fixed together permanently.

The partition walls 10 may or may not be made as removable inserts, fitted within the chamber into complementary slots or grooves.

The materials will be selected according to different needs. When the chamber is to be used for centrifugation under sterile conditions, autoclavable materials such as metals, glass or silicone are advantageous.

An examplary model of the gradient chamber may be disassembled into two or more components for cleaning purposes. These components may correspond to the functional parts described above. At the contacting surface of the bottom part facing the walls of the middle part there are complementary fitting grooves to receive and tightly fix the middle part and a gasket between both parts. When assembled the gradient chamber is tightened by means of either screws, clamps or other connecting parts. During centrifugation the components are pressed together mainly by centrifugal force.

In FIG. 7 a different realization of a compartmentalized centrifugation chamber is shown.

A large centrifuge tube 50 is compartmentalized by an insert comprising lamellae 10*a* (two shown in FIG. 7) and connecting bars of different length 52, 54.

The measurements of the lamellae 10*a* and the connecting bars 52 and 54 are adapted to a given tube and a given rotor in a way that orients the lamellae 10*a* in planes coinciding with centrifugal force lines 18*a* and parallel to the axis of rotation 16 during centrifugation.

It is evident that in accordance with the principle of the compartmentalized centrifugation chamber, the insert may comprise any number of lamellae necessary to prevent vortex formation during a given kind of centrifugation.

What is claimed is:

1. A compartmentalized centrifugation chamber for holding a sample including a medium and particles dispersed therein, subdivided by partitions into several hydrostatically communicating compartments, said chamber adapted to be carried by a swinging-bucket centrifuge rotor, said partitions substantially being positioned during centrifugation in planes coinciding with centrifugal force lines and further being parallel to the axis of rotation.

2. A compartmentalized centrifugation chamber as defined in claim 1, comprising a bottom part containing a channel with narrow openings to the base of each of the compartments of said chamber, said openings diverging in form resembling hollow oblong pyramids towards said compartments, which thereby communicate hydrostatically by said channel, said channel further communicating with a tubing connector, said chamber further comprising a middle part containing said compartments, said chamber further comprising a top part designed similarly to said bottom part.

3. A compartmentalized centrifugation chamber as defined in claim 2, which comprises a carrier part for suspending said chamber in the centrifuge rotor.

4. An insert for use with a centrifuge tube defining a volume for holding a sample including a medium and particles dispersed therein, said insert comprising a multiplicity of partitions, and sized and adapted, when disposed within the volume of said centrifuge tube, to subdivide said volume into several hydrostatically communicating compartments, said partitions substantially being positioned during centrifugation in planes coinciding with centrifugal force lines and further being parallel to the axis of rotation.

* * * * *